US005385756A

United States Patent [19]

Lofton

[11] Patent Number: 5,385,756

[45] Date of Patent: Jan. 31, 1995

[54] FORMALDEHYDE-FREE BINDER

[75] Inventor: Elizabeth P. Lofton, Horsham, Pa.

[73] Assignee: Rohm and Haas Company, Philadelphia, Pa.

[21] Appl. No.: 961,551

[22] Filed: Sep. 21, 1992

Related U.S. Application Data

[62] Division of Ser. No. 576,574, Aug. 31, 1990.

[51] Int. Cl.[6] ..... B05D 3/02

[52] U.S. Cl. ..... 427/389.9; 427/393.4

[58] Field of Search ..... 427/389.9, 393.4, 389

[56] References Cited

U.S. PATENT DOCUMENTS

| | | | |
|---|---|---|---|
| 2,609,350 | 9/1952 | Spatt | 427/393.4 |
| 2,884,336 | 4/1959 | Loshaek | 427/389 |
| 3,238,168 | 3/1966 | Wolff et al. | 427/389.9 |
| 3,585,070 | 6/1971 | Williams | 427/389 |
| 3,981,836 | 9/1976 | Pangle, Jr. et al. | 427/389.9 |
| 4,002,785 | 1/1977 | Grossmann et al. | 427/389 |
| 4,059,665 | 11/1977 | Kelley | 264/128 |
| 4,073,993 | 2/1978 | Lark | 427/393.4 |
| 4,352,917 | 10/1982 | Tripp | 427/387 |
| 4,420,583 | 12/1983 | Hutton | 524/501 |
| 4,430,381 | 2/1984 | Harvey et al. | 427/393.4 |
| 4,455,342 | 6/1984 | Fink et al. | 427/389.9 |
| 4,563,289 | 1/1986 | Thompson | 252/8.8 |
| 4,702,944 | 10/1987 | Thompson | 427/389.8 |
| 4,756,714 | 7/1988 | Hendrix et al. | 8/115.6 |
| 4,835,020 | 5/1989 | Itoh et al. | 427/389.9 |
| 5,011,712 | 4/1991 | Pangrazi et al. | 427/389.9 |
| 5,124,181 | 6/1992 | Schaffer et al. | 427/393.4 |
| 5,151,329 | 9/1992 | Noll et al. | 427/389 |

OTHER PUBLICATIONS

Derwent Abstract No. 87-304180 of Japanese Patent Application JP 62/215073A, Sep. 1987.

*Primary Examiner*—Shrive Beck
*Assistant Examiner*—Diana Dudash
*Attorney, Agent, or Firm*—Ronald D. Bakule

[57] ABSTRACT

A method for treating a flexible, porous substrate with a water-borne formaldehyde-free composition and a flexible, porous substrate so treated are provided. More particularly, this invention is directed to a method for treating a nonwoven fabric with an emulsion-polymerized binder containing certain copolymerized ethylenically-unsaturated dicarboxylic acids, or derivatives thereof, wherein the binder is partially neutralized with a fixed base.

4 Claims, No Drawings

FORMALDEHYDE-FREE BINDER

This is a division of application Ser. No. 07/576,574, filed Aug. 31, 1990.

FIELD OF THE INVENTION

This invention relates to an improved method for treating a flexible, porous substrate with a water-borne formaldehyde-free composition and a flexible, porous substrate so treated. More particularly, this invention is directed to a method for treating a nonwoven fabric with an emulsion-polymerized binder containing certain copolymerized ethylenically-unsaturated dicarboxylic acids, or derivatives thereof, wherein the binder is partially neutralized with a fixed base.

BACKGROUND OF THE INVENTION

Flexible, porous substrates are frequently consolidated or strengthened by treating them with a polymeric binder. Flexible, porous substrates such as, for example, paper, woven fabrics, and nonwoven fabrics, are frequently treated with solutions or dispersions containing polymeric binders in order to impart improved properties. Properties such as, for example, resiliency, crock resistance, dryclean resistance, wash durability, tear strength, fold endurance, and the like, may be improved by applying a polymeric binder to flexible, porous substrates where the binder is disposed in or on the substrate.

In many instances it is desirable to apply an aqueous solution or dispersion containing a polymeric binder to a flexible, porous substrate, wherein the binder is present in a substantially thermoplastic, or substantially uncrosslinked, state, in order that flow, penetration, film formation, and the like, may occur after the binder solution or dispersion has contacted the substrate. It is also frequently desirable to effect crosslinking once the binder has achieved its final location, or concurrently with the drying process, in order to enhance the properties of the treated substrate. Many of the conventional crosslinking agents such as, for example, copolymerized N-methylol acrylamide and added urea/formaldehyde resins inherently contain or liberate formaldehyde, a skin and eye irritant, a mutagen, and a suspect carcinogen. A formaldehyde-free binder which is capable of effective crosslinking is needed for the treatment of porous substrates. The improved method of this invention for treating a flexible, porous substrate with a formaldehyde-free composition solves this problem.

DESCRIPTION OF THE PRIOR ART

U.S. Pat. No. 4,405,325 discloses hydrophobic nonwoven fabrics bonded with a water-insoluble hydrophobic binder selected from emulsion polymers of 50 to 80 parts styrene and 50 to 20 parts butadiene, which polymers have a glass transition temperature in the range of −5 C. to 25 C.. Also disclosed is the incorporation of a small amount of a hydrophilic comonomer, not exceeding about 5 parts by weight, such as, for example, acrylic acid, methacrylic acid, itaconic acid, and acrylamide. Partial neutralization of the binder with a permanent base is not disclosed.

U.S. Pat. No. 3,959,552 discloses a process for the production of cleaning-resistant nonwoven materials using aqueous dispersions of copolymers of N-methylolacrylamide and/or N-methylol-methacrylamide, acrylamide and/or methacrylamide, alpha, beta-monoolefinically unsaturated dicarboxylic and/or tricarboxylic acids, and, optionally, other monomers. The copolymers incorporate 0.5 to 3% by weight of the dicarboxylic or tricarboxylic acids having 4 to 6 carbon atoms, or mixtures thereof. The acids are preferably maleic acid, fumaric acid, itaconic acid, citraconic acid, or aconitic acid, or mixtures thereof. The copolymer compositions were neutralized to pH=2.5 with oxalic acid during the process of saturating the nonwoven.

U.S. Pat. No. 2,931,749 discloses binders for fibrous nonwoven products, which binders are aqueous dispersions of a water-insoluble linear copolymer, or salts thereof, of monoethylenically unsaturated monomeric units containing 0.5 to 10 percent by weight of units containing carboxyl groups. The copolymer may be applied in free acid form, in the form of an alkali metal salt, or as a salt of a water-soluble amine, such as methylamine, diethylamine, triethylamine, mono-,di-, or tri-ethanolamine, or morpholine. It is further disclosed to apply the copolymer dispersion at a pH of at least about 5 and preferably at a pH between 6 and 10.

U.S. Pat. No. 4,059,665 discloses non-woven fibrous products bonded together by a binder comprising a heat-cured product of a water-insoluble copolymer, which copolymer may contain units derived from unsaturated aliphatic carboxylic acids such as acrylic acid, methacrylic acid, citraconic acid, and, preferably, itaconic acid. An acidic catalyst may be used.

U.S. Pat. No. 4,406,660 discloses non-woven fibrous products in which the fibers are bound together by an emulsion copolymer which contains 0.5–10%, by weight, of acid containing at least one ethylenically unsaturated dicarboxylic acid, optionally in combination with at least one ethylenically unsaturated monocarboxylic acid. The acid component may comprise dicarboxylic acids such as itaconic or maleic acid and, optionally, monocarboxylic acids such as acrylic or methacrylic acid; itaconic acid is preferred for improved wet strength. The acid component(s) may be in the form of free acid or may be in the form of a salt with, for example, an alkali metal, such as sodium or potassium, a water-soluble amine such as methylamine, diethylamine, triethyl amine, mono-, di-, or tri-ethanolamine, or morpholine, or in the form of an ammonium salt.

U.S. Pat. No. 4,929,495 discloses a combination of an acrylic binder and fibers forming a nonwoven fabric. The binder contains copolymerized therein from about 1 to about 20 weight parts of at least one unsaturated dicarboxylic acid containing 4 to about 10 carbon atoms. Partial neutralization of the binder with a permanent base is not disclosed.

U.S. Pat. No. 4,524,093 discloses an improved aqueous polymeric composition, which, when used as a coating for fabrics, substantially reduces the evolution of formaldehyde, and exhibits good dry cleaning resistance and low temperature flexibility. The composition contains an aqueous emulsion of acrylate monomers copolymerized with acrylonitrile, itaconic acid, and N-methylolacrylamide; and containing a glyoxal curing resin and a Lewis acid or organic acid as catalyst.

U.S. Pat. Nos. 4,563,289 and 4,702,944 (a division of the same SN) disclose nonwoven products of natural or synthetic fibers having good heat stability, good wet strength and a low amount of crosslinking agents such as urea-formaldehyde or N-methylolacrylamide. The nonwoven products incorporate as a binder a latex of a polymer containing a carboxylic acid functional group, in particular, a C3–C9 ethylenically unsaturated carboxylic acid or an anhydride of a C4–C9 ethylenically unsaturated dicarboxylic acid, said latex containing sufficient alkali metal base to provide a pH of from about 5 to about 9, preferably in conjunction with a latent acid. Suitable ethylenically unsaturated acids include acrylic, methacrylic, fumaric, itaconic, butenoic, pentenoic, hexenoic, and octenoic acids.

None of the references disclose a method for treating a flexible, porous substrate with a water-borne polymeric binder containing selected copolymerized dicarboxylic acids, or certain derivatives thereof, wherein the binder is partially neutralized with a permanent base.

It is an object of this invention to provide an improved method for treating flexible, porous substrates. It is an another object of this invention to provide an improved method for treating nonwoven substrates with an emulsion-polymerized binder. It is an additional object of this invention to provide a method for treating a nonwoven substrate with a formaldehyde-free binder. It is another object of this invention to provide a polymer-treated nonwoven substrate with improved wash- and dryclean-durability prepared by a formaldehyde-free treatment.

SUMMARY OF THE INVENTION

A method is provided for treating a flexible, porous substrate with a water-borne formaldehyde-free composition containing at least one polymeric binder, the binder containing from about 0.5% to about 10%, by weight based on the weight of the polymeric binder, of at least one ethylenically-unsaturated dicarboxylic acid, the half ester thereof, or the anhydride thereof, wherein the binder is partially neutralized with a fixed base. Flexible, porous substrates so treated are also provided.

DETAILED DESCRIPTION OF THE INVENTION

This invention is directed to a method for treating a flexible, porous substrate with a water-borne formaldehyde-free composition, and the treated substrates so produced.

Flexible, porous substrates such as, for example, woven and nonwoven fabrics, paper, leather, and the like, are treated with a waterborne formaldehyde-free composition in order to enhance the strength, appearance, or durability properties of the substrate. The waterborne formaldehyde-free composition contains a polymeric binder as a solution of polymeric binder(s) in aqueous media; as an aqueous dispersion such as, for example, an emulsion-polymerized dispersion; or as an aqueous suspension. Aqueous herein includes water and mixtures composed substantially of water and water-miscible solvents. Preferred is an emulsion-polymerized aqueous dispersion.

The polymeric binder used in this invention is a substantially thermoplastic, or substantially uncrosslinked, polymer when it is applied to the substrate, although low levels of deliberate or adventitious crosslinking may be present. On heating the binder, the binder is dried and curing is effected, either sequentially or concurrently. By curing is meant herein a structural or morphological change which is sufficient to alter the properties of a flexible, porous substrate to which an effective amount of polymeric binder has been applied such as, for example, covalent chemical reaction, ionic interaction or clustering, improved adhesion to the substrate, phase transformation or inversion, hydrogen bonding, and the like.

The polymeric binder contains at least one copolymerized ethylenically-unsaturated dicarboxylic acid, the half ester thereof, or the anhydride thereof, in an amount of from about 0.5 to about 10% by weight based on the weight of the polymeric binder. For example, iraconic acid, fumaric acid, maleic acid, monomethyl itaconate, monomethyl fumarate, monobutyl fumarate, or maleic anhydride may be used. Itaconic and fumaric acid at a level of from about 2% to about 8% by weight, based on the weight of the polymeric binder, are preferred. Itaconic acid and fumaric acid at a level of from about 4% to about 6% by weight, based on the weight of the polymeric binder, are most preferred.

The polymeric binder also contains from about 90% to about 99.5% by weight, based on the weight of the polymeric binder, of at least one ethylenically unsaturated monomer. For example, acrylic ester monomers including methyl acrylate, ethyl acrylate, butyl acrylate, 2-ethylhexyl acrylate, decyl acrylate, methyl methacrylate, butyl methacrylate, hydroxyethyl acrylate, hydroxyethyl methacrylate, and hydroxypropyl methacrylate; acrylamide or substituted acrylamides; styrene or substituted styrenes; butadiene; vinyl acetate or other vinyl esters; acrylonitrile or methacrylonitrile; and the like, may be used. Predominant amounts of ethyl acrylate are preferred. When low levels of precrosslinking or gel content are desired in cases where the polymeric binder is provided in particulate form, low levels of multi-ethylenically unsaturated monomers such as, for example, allyl methacrylate, diallyl phthalate, 1,4-butylene glycol dimethacrylate, 1,6-hexanedioldiacrylate, and the like, may be used. Low levels of ethylenically-unsaturated monocarboxylic acids such as, for example, 0–5%, by weight based on the weight of the polymeric binder, methacrylic acid or acrylic acid may be used.

The glass transition temperature of the polymeric binder has an effect on the rigidity, flexibility, and "hand" of the treated porous substrate. Glass transition temperatures, as calculated by the Fox equation, from about +40 C. to about −60 C. are preferred.

Chain transfer agents including mercaptans, polymercaptans, and halogen compounds are sometimes used in the polymerization mixture in order to moderate the molecular weight of the polymeric binder. Generally, from 0% to about 3% by weight, based on the weight of the polymeric binder, of C4–C20 alkyl mercaptans, mercaptopropionic acid, or esters of mercaptopropionic acid, may be used. Preferred is the use of no chain transfer agent.

This invention is directed to a method for treating a flexible, porous substrate with a waterborne formaldehyde-free composition. By formaldehyde-free composition herein is meant that the composition is substantially free from formaldehyde, nor does it liberate substantial formaldehyde as a result of drying and/or curing. In order to minimize the formaldehyde content of the waterborne composition it is preferred, when preparing the polymeric binder, to use polymerization adjuncts such as, for example, initiators, reducing agents, chain transfer agents, biocides, surfactants, and the like, which are themselves free of formaldehyde, do not generate formaldehyde during the polymerization process, and do not generate or emit formaldehyde during the treatment of flexible, porous substrates. When low levels of formaldehyde are acceptable in the waterborne composition or compelling reasons exist for using adjuncts which generate or emit formaldehyde, substantially formaldehyde-free waterborne compositions may be used.

When the polymeric binder is in the form of an emulsion-polymerized aqueous dispersion, relatively small particle size such as, for example, 60 nanometers is preferred over relatively large particle size such as, for example, 250 nanometers. When the polymeric binder is prepared in the form of an emulsion-polymerized aqueous dispersion, it is preferred to add all of the dibasic acid to the reaction vessel prior to the initiation of the polymerization reaction in order to enhance its incorporation into the polymeric binder. When the polymeric binder is in the form of an emulsion-polymerized aqueous dispersion, the particles may be composed of two or more phases such as, for example, core/shell particles, core/shell particles with shell phases incompletely encapsulating the core, core/shell particles with a multiplicity of cores, interpenetrating network particles, and the like.

Contacting the waterborne formaldehyde-free composition containing the polymeric binder, the binder containing copolymerized ethylenically unsaturated dicarboxylic acid, the half ester thereof, or the anhydride thereof, defined as neutralization herein, with a fixed base is required prior to treating the porous substrate. Neutralization of about 20% to about 80% of the dicarboxylic acid groups, calculated on an equivalents basis, with a fixed base is required. When the half ester of a dicarboxylic acid or the anhydride of a dicarboxylic acid is used, the equivalents of acid are calculated to be equal to those of the dicarboxylic acid derivative used. Preferred is neutralization of about 40% to about 60% of the dicarboxylic acid groups, calculated on an equivalents basis, with a fixed base. Fixed base, or permanent base, as used herein, refers to a monovalent base which is substantially non-volatile under the conditions of the treatment such as, for example, potassium hydroxide, sodium carbonate, or t-butylammonium hydroxide. Volatile bases such as, for example, ammonia or lower alkyl amines, do not function as the fixed base of this invention, but may be used in addition to the fixed base, without contributing to the required degree of neutralization by a fixed base. Fixed multivalent bases such as, for example, calcium carbonate may tend to destabilize the latex but may be used in minor amount.

In addition, conventional treatment components such as, for example, emulsifiers, pigments, fillers, anti-migration aids, curing agents, coalescents, wetting agents, biocides, plasticizers, anti-foaming agents, colorants, waxes, antioxidants, may be used in the waterborne formaldehyde-free composition. Preferred is the use of an anti-migration aid such as, for example, an inorganic salt or a quaternary ammonium salt. More preferred is the use of a quaternary ammonium salt anti-migration aid such as, for example, trimethyltaliow-ammonium chloride or diallyldimethyl-ammonium chloride ("DADMAC"). Most preferred is the use of DADMAC at a level of about 0.5% to about 1.0% by weight, based on the dry weight of the polymeric binder.

The flexible, porous substrates treated by the method of this invention include paper, leather, woven or nonwoven fabrics, and the like. The nonwoven fabrics may contain natural fibers such as, for example, wood pulp, or synthetic fibers such as, for example, polyester, rayon, and glass, or mixtures thereof. The waterborne formaldehyde-free composition may be applied by conventional techniques such as, for example, air or airless spraying, padding, saturating, roll coating, curtain coating, or the like.

The waterborne formaldehyde-free composition, after it is applied to the flexible, porous substrate, is heated to effect drying and curing. The duration and temperature of heating will affect the rate of drying, processability and handleability, and property development of the treated substrate. Heat treatment of 150 C. for 5 minutes is preferred, but treatment at 180 C. for 5 minutes is preferred for substrates able to withstand that treatment.

The following examples are intended to illustrate the method for treating a flexible, porous substrate, to which this invention is directed. They are not intended to limit the invention as other applications of the invention will be obvious to those of ordinary skill in the art.

EXAMPLE 1

Preparation of Waterborne Polymeric Binder Containing Itaconic Acid

Preparation of Sample 1

To a 3-liter stirred glass reactor which contained 710 g. deionized ("DI") water and 65.6 g. sodium lauryl sulfate and which had been swept with nitrogen for 30 minutes at ambient temperature and then heated to 57 C. was added 66 g. Monomer Emulsion #1 ("ME#1") and 15 g. of DI water. After two minutes, solutions of 5 g. 0.15% aqueous iron sulfate heptahydrate, 3.33 g. ammonium persulfate in 20 g. DI water, and 0.17 g. sodium bisulfite in 20 g. DI water were added at a temperature of 56 C. An exotherm to 61.5 C. was observed over the next two minutes and the concurrent addition of the balance of ME#1 and a solution of 0.88 g. sodium bisulfite in 60 g. DI water was begun. The addition proceeded over a period of 126 minutes with the temperature during the addition being 56.5 C.–61.5 C. At the end of the addition 30 g. DI water was added. After a period of 55 minutes during which the temperature had fallen from 58 C. to 49 C., solutions of 1.0 g. t-butyl hydroperoxide in 10 g. DI water and 0.7 g. sodium sulfoxylate formaldehyde in 10 g. DI water were added. Fifteen minutes later, with the temperature at 47 C., identical t-butyl hydroperoxide and sodium sulfoxylate formaldehyde solutions were added. After an additional 15 minutes, with the temperature at 44.5 C., two additional identical solutions were added. Sample 1 had a solids content of 38.2% and a particle size of 60 nanometers.

TABLE 1.1 Monomer Emulsion #1 (ME#1) for Example 1

650 g. DI water
16.5 g. sodium lauryl sulfate
950 g. ethyl acrylate (EA)
50 g. itaconic acid (IA)

EXAMPLE2

Preparation of Waterborne Polymeric Binder Containing Fumaric Acid

Preparation of Sample 2

To a 3-liter stirred glass reactor which contained 1000 g. deionized ("DI") water, 5 g. sodium lauryl sulfate, and 50 g. fumaric acid (FA) and which had been swept with nitrogen for 30 minutes at ambient temperature and then heated to 55 C. was added 66 g. Monomer Emulsion #1 ("ME#1") and 15 g. of DI water. After two minutes, solutions of 5 g. 0.15% aqueous iron sulfate heptahydrate, 3.3 g. ammonium persulfate in 20 g. DI water, and 0.17 g. sodium bisulfite in 20 g. DI water were added at a temperature of 55 C. An exotherm to 59 C. was observed over the next minute and the concurrent addition of the balance of ME#1 and a solution of 0.88 g. sodium bisulfite in 60 g. DI water was begun. The addition proceeded over a period of 125 minutes with the temperature during the addition being 55.5 C.–59 C. At the end of the addition 30 g. DI water was added. After a period of 20 minutes during which the temperature had fallen from 56 C. to 49 C., solutions of 1.0 g. t-butyl hydroperoxide in 10 g. DI water and 0.7 g. isoascorbic acid in 10 g. DI water were added. Fifteen minutes later, with the temperature at 45 C., identical t-butyl hydroperoxide and isoascorbic acid solutions were added. After an additional 15 minutes, with the temperature at 42 C., two additional identical solutions were added. Sample 2 had a solids content of 39.0% and a particle size of 100 nanometers.

TABLE 2.1 Monomer Emulsion #1 (ME#! ) for Example 2

300 g. DI water
28.3 g. sodium lauryl sulfate
950 g. ethyl acrylate

COMPARATIVE EXAMPLE A

Preparation of Waterborne Polymeric Binder Containing Methacrylic Acid

Preparation of Comparative Sample A

To a 3-liter stirred glass reactor which contained 710 g. deionized ("DI") water and 65.6 g. sodium lauryl sulfate and which had been swept with nitrogen for 30 minutes at ambient temperature and then heated to 57 C. was added 66 g. Monomer Emulsion #1 ("ME#1") and 15 g. of DI water. After two minutes, solutions of 5 g. 0.15% aqueous iron sulfate heptahydrate, 3.33 g. ammonium persulfate in 20 g. Di water, and 0.17 g. sodium bisulfite in 20 g. DI water were added at. a temperature of 56 C. An exotherm to 61 C. was observed over the next minute and the concurrent addition of the balance of ME#1 and a solution of 0.88 g. sodium bisulfite in 60 g. DI water was begun. The addition proceeded over a period of 120 minutes with the temperature during the addition being 56 C.–61 C. At the end of the addition 30 g. DI water was added. After a period of 55 minutes during which the temperature had fallen from 56 C. to 48 C., solutions of 1.0 g. t-butyl hydroperoxide in 10 g. DI water and 0.7 g. sodium sulfoxylate formaldehyde in 10 g. DI water were added. Fifteen minutes later, with the temperature at 46 C., identical t-butyl hydroperoxide and sodium sulfoxylate formaldehyde solutions were added. After an additional 15 minutes, with the temperature at 43.5 C., two additional identical solutions were added. Sample 1 had a solids content of 38.3% and a particle size of 60 nanometers.

TABLE A.1 Monomer Emulsion #1 (ME#1) for Comparative

EXAMPLE A 650 g. DI water
16.5 g. sodium lauryl sulfate
945 g. ethyl acrylate (EA)
55 g. acrylic acid (AA)

EXAMPLE 3

Neutralization of Acid-containing Waterborne Polymeric Binders

To waterborne polymeric binders were added water and aqueous solutions of fixed base, with stirring, as noted in the following Table.

TABLE 3.1 Formulation of Sample 1 (all Quantities in grams)

| Sample | Sample 1 | DI water | 5% Na2CO3 | 10% KOH | 10% DADMAC |
|---|---|---|---|---|---|
| 1A | 125 | 406.94 | 0 | 0 | 0 |
| 1B | 75 | 240.58 | 2.35 | 1.24 | 0 |
| 1C | 75 | 236.99 | 4.71 | 2.47 | 0 |
| 1D | 125 | 388.84 | 7.84 | 4.12 | 6.14 |
| 1E | 75 | 233.4 | 7.06 | 3.71 | 0 |
| 1F | 125 | 377.03 | 19.61 | 10.30 | 0 |

TABLE 3.2 Formulation of Sample 2 (all quantities in grams)

| Sample | Sample 2 | DI water | 5% NaOH | 10% KOH | 10% DADMAC |
|---|---|---|---|---|---|
| 2A | 65 | 216.67 | — | — | — |
| 2B | 65 | 214.58 | 0.87 | 1.22 | — |
| 2C | 65 | 212.48 | 1.75 | 2.44 | — |
| 2D | 65 | 209.94 | 1.75 | 2.44 | 2.54 |
| 2E | 65 | 211.21 | 1.75 | 2.44 | 1.27 |
| 2F | 65 | 210.39 | 2.62 | 3.66 | — |
| 2G | 65 | 206.2 | 4.37 | 6.1 | — |
| 2H | 65 | 211.79 | — | 4.88 | — |
| 2I | 65 | 213.18 | 3.49 | — | |
| 2J | 65 | 203.58 | — | 13.09 | CsOH (10%) |

TABLE 3.3 Formulation of Comparative Sample A (all quantities in grams)

| Sample | Comp. Sample A | DI water | 5% Na2CO3 | 10% KOH | 10% DADMAC |
|---|---|---|---|---|---|
| AA | 125 | 406.94 | 0 | 0 | 0 |
| AB | 75 | 240.58 | 2.35 | 1.24 | 0 |
| AC | 75 | 236.99 | 4.71 | 2.47 | 0 |
| AD | 125 | 388.84 | 7.84 | 4.12 | 6.14 |
| AE | 75 | 233.4 | 7.06 | 3.71 | 0 |
| AF | 125 | 377.03 | 19.61 | 10.30 | 0 |

NOTE: DADMAC as used herein is diallyldimethylammonium chloride.

Sample 1 (5 wt. % itaconic acid) and Comparative Sample A (5.5 wt. % acrylic acid) are eqimolar in equivalents of copolymerized acid; Sample 2 contains 5 wt. % fumaric acid. The fixed bases used to neutralize the copolymerized acid in Example 2 are 0%, 20%, 40%, 60%, or 100% neutralization of the copolymerized acids, using equal ion amounts of potassium and sodium; in addition, there is a 40% neutralization point for each of the binders (1D, 2D, AD) wherein the neutralization is effected with 20% potassium, 20% sodium, and, additionally, 10% DADMAC is added. Sample 2E is neutralized with 20% potassium, 20% sodium, and, additionally,5% DADMAC was added; Sample 2J is neutralized with 40% cesium. The physical characteristics of the neutralized treatments are presented in Table 3.4 below.

TABLE 3.4. Characteristics of Neutralized Treatments

| Sample | % Copolymerized Acid Neutralized | pH |
|---|---|---|
| 1A | 0 | 3.00 |
| 1B | 20 | 5.88 |
| 1C | 40 | 6.76 |
| 1D | 40 | 6.75 |
| 1E | 60 | 7.21 |
| 1F | 100 | 8.01 |
| 2A | 0 | 2.51 |
| 2B | 20 | 4.48 |
| 2C | 40 | 6.26 |
| 2D | 40 | 6.40 |
| 2E | 40 | 6.49 |
| 2F | 60 | 6.98 |
| 2G | 100 | 8.19 |
| 2H | 40 | 5.97 |
| 2I | 40 | 6.41 |
| 2J | 40 | 6.28 |
| AA | 0 | 2.76 |
| AB | 20 | 6.51 |
| AC | 40 | 7.06 |
| AD | 40 | 7.12 |
| AE | 60 | 7.43 |
| AF | 100 | 7.86 |

EXAMPLE 4

Treating Nonwoven Substrates and Testing for Wash- and Dryclean-Durability and Web Tensile Strengths A carded polyester nonwoven web, made of DACRON 371W (1.5 denier 1.5 inch staple length), of 1 ounce/square yard weight was used for durability testing. The neutralized treatments prepared in Example 3 at 9% polymer solids were used. The web, supported by fiberglass scrim, was saturated in a bath of the treatments of Example 3, and then passed through a Birch Bros. padder at 40 psig. The coated web was removed from the scrim and placed on a wire screen in a Mathis oven at 150 C. for 5 minutes. A binder add-on, which was about 45%, by weight based on weight of the web, was measured for each web. The durability of the treated nonwoven web was tested in standard drycleaner and laundry machines. Web tensile strengths were tested as described below.

For drycleaning the webs were sewn onto a 50/50 polyester/cotton fabric. These samples were put into a SPEED QUEEN Model CD2811 commercial drycleaner with five terry cloth towels. DOWPER CS drycleaning solvent was used; the samples were drycleaned for five consecutive cycles. The samples were then rated compared to a set of standards on a scale of 1 to 5. A "5" rating means that the sample was perfect and had sustained no damage, whereas a "1" rating was assigned for a sample which was highly piled and ripped. Intermediate ratings corresponded to intermediate amounts of piling and structural damage.

Laundry durability was rated in a KENMORE Ultra Fabric Care Heavy Duty 80 Series machine using an approximate 0.15 wt. % solution of PENNWALT PENNICO PLUS detergent in 130 F. water. Ten terry cloth towels were added to the machine. The test was repeated until the webs ripped into more than one piece.

Web tensile strengths were measured in the cross machine direction using one inch-wide strips of the saturated nonwoven web as prepared above. The strips were mounted on a Thwing-Albert Intellect II INSTRON tester. Samples were extended until break, using a 3 inch gage length at an elongation rate of 12 inches/minute. The peak load was recorded. Samples were tested after 30 minute soaks in DOWPER CS or hot (130 F.) detergent solutions.

Table 4.1 Wash- and Dryclean-Durability of Treated Nonwoven Samples

| Sample | Wash-Durability (Cycles Passed) | Dryclean-Durability (Rating) | Tensile Strength (g./in.) DOWPER | Tensile Strength (g./in.) Hot Deter. |
|---|---|---|---|---|
| 1A | 13 | 3.3 | 111 | 215 |
| 1B | 39 | 3.5 | 355 | 545 |
| 1C | 40 | 3.6 | 410 | 664 |
| 1D | 51 | 4.0 | 430 | 656 |
| 1E | 40 | 3.8 | 419 | 447 |
| 1F | 7 | 3.0 | 290 | 112 |
| 2A | 3 | 3.0 | 120 | 193 |
| 2B | 13 | 3.75 | 303 | 584 |
| 2C | 29 | 4.25 | 393 | 565 |
| 2D | >53 | 5 | 429 | 566 |
| 2E | 44 | 4.75 | 427 | 592 |
| 2F | 32 | 4.5 | 432 | 415 |
| 2G | 9 | 4.0 | 348 | 176 |
| 2H | 42 | 4.75 | 467 | 624 |
| 2I | 14 | 3.9 | 399 | 518 |
| 2J | >53 | 4.25 | 523 | 545 |
| AA | 2 | 2.5 | 66 | 71 |
| AB | 2 | 2.75 | 146 | 125 |
| AC | 2 | 3.0 | 262 | 111 |
| AD | 4 | 3.45 | 251 | 110 |
| AE | 2 | 3.3 | 335 | 87 |
| AF | 1 | 3.0 | 261 | 67 |

Samples 1B, 1C, 1D, and 1E of this invention exhibit improved dryclean durability, vastly superior wash durability, and higher wet tensile strengths relative to the samples of the same polymer not neutralized to the required degree with a fixed base (Samples 1A,1F) and, particularly, to the acrylic acid-containing Comparative Samples (AA–AF), regardless of the degree of neutralization.

Samples 2B, 2C, 2D, 2E, 2F, 2H, 21, and 2J of this invention exhibit improved dryclean durability, vastly superior wash durability, and higher wet tensile strengths relative to the samples of the same polymer not neutralized to the required degree with a fixed base (Samples 2A, 2G) and, particularly, to the acrylic acid-containing Comparative Samples (AA–AF), regardless of the degree of neutralization. The addition of DADMAC, a cationic quaternary ammonium compound which may affect migration resistance during the treatment of the nonwoven, provided improved performance, particularly in the dryclean-durability of the treated nonwoven,

EXAMPLE 5

Wash- and Dryclean-Durability of Polymeric Binder Neutralized with Quaternary Ammonium Hydroxide Fixed Base Sample 1 was neutralized with tetrabutylammonium hydroxide as in Example 3, applied to a nonwoven web and tested as in Example 4, with the following results.

Table 5.1 Treatment and Performance of Nonwovens Using Tetrabutylammonium Hydroxide Fixed Base for Neutralization

| Sample | % Neutralized | pH | Wash-Durability (Cycles passed) | Dryclean Durability (Rating) |
|---|---|---|---|---|
| 5A | 0 | 2.58 | 10 | 3 |
| 5B | 20 | 4.66 | 18 | 3.4 |

-continued

| Sample | % Neutralized | pH | Wash-Durability (Cycles passed) | Dryclean Durability (Rating) |
|---|---|---|---|---|
| 5C | 40 | 5.40 | 16 | 3.9 |
| 5D | 60 | 6.25 | 16 | 3.6 |
| 5E | 100 | 8.90 | 3 | 1 |

Samples 5B, 5C, and 5D of this invention exhibit superior wash- and dryclean-durability relative to Samples 5A and 5E not neutralized to the required degree with a fixed base.

EXAMPLE 6

Dryclean-durability of a Waterborne Polymeric Binder Containing Itaconic Acid, Neutralized to the Extent of 40% with Volatile or Fixed Bases Sample 1 was formulated, applied to a substrate, and evaluated for dryclean-durability according to Examples 3 and Table 6.1 Treatment and Performance of Nonwovens Using Volatile or Fixed Base for Neutralization

| Sample | % Neutralized/Base | pH | Dryclean-durability (Rating) |
|---|---|---|---|
| 6A | 0% | 2.9 | 2.9 |
| 6B | 50% NH4OH | 7.5 | 3.25 |
| 6C | 20% Na2CO3 + 20% KOH | 6.7 | 4.1 |
| 6D | 20% NaOH + 20% KOH | 6.7 | 4.5 |
| 6E | 40% NaOH | 6.9 | 4.75 |

In addition to the neutralizing base Samples 6C, 6D, and 6E contained DADMAC at a level of 10% based on equivalents of acid.

Samples 6C, 6D, and 6E of this invention were neutralized to a degree within the required degree of neutralization with a fixed base. Sample 6B, which was neutralized to a degree within the required degree of neutralization, but with ammonium hydroxide, a volatile base, gave poorer dryclean-resistance, as did Sample 6A which was not neutralized.

EXAMPLE 7

Preparation of a Harder Waterborne Polymeric Binder Containing Fumaric Acid, Neutralization, Application to a Substrate, and Evaluation Preparation of Sample 7. To a 3-liter stirred glass reactor which contained 1000 g. deionized ("DI") water, 30 g. sodium lauryl sulfate, and 40 g. fumaric acid and which had been swept with nitrogen for 30 minutes at ambient temperature and then heated to 60 C. was added 66 g. Monomer Emulsion #1 ("ME#1") and 15 g. of DI water. After two minutes, solutions of 5 g. 0.15% aqueous iron sulfate heptahydrate, 3.3 g. ammonium persulfate in 20 g. DI water, and 0.17 g. sodium bisulfite in 20 g. DI water were added at a temperature of 60 C. An exotherm to 63 C. was observed over the next minute and the concurrent addition of the balance of ME#1 and a solution of 0.88 g. sodium bisulfite in 60 g. DI water was begun. The addition proceeded over a period of 124 minutes with the temperature during the addition being 63–65.5 C. At the end of the addition 20 g. DI water was added. After a period of 30 minutes during which the temperature had fallen from 65 C. to 55 C., solutions of 1.0 g. t-butyl hydroperoxide in 10 g. DI water and 0.7 g. isoascorbic acid in 10 g. DI water were added. Twenty minutes later, with the temperature at 48 C., identical t-butyl hydroperoxide and isoascorbic acid solutions were added. After an additional 15 minutes, with the temperature at 45 C., two additional identical solutions were added. Sample 7 had a solids content of 38.7% and a particle size of 60 nanometers.

TABLE 7.1 Monomer Emulsion #1 (ME#! ) for Example 7

300 g. DI water
51.6 g. sodium lauryl sulfate
560 g. ethyl acrylate
400 g. methyl methacrylate Portions of Sample 7 were neutralized according to the method of Example 3 using the neutralizing agents and achieving the pH values as given below in Table 7.2.

TABLE 7.2. Characteristics of Neutralized Treatments

| Sample | % Copolymerized Acid Neutralized | pH |
|---|---|---|
| 7A | 0 | 2.53 |
| 7B | 10% Na2CO3 + 10% KOH | 4.20 |
| 7C | 20% Na2CO3 + 20% KOH | 5.07 |
| 7D | 20% Na2CO3 + 20% KOH (+10% DADMAC) | 5.18 |
| 7E | 30% Na2CO3 + 30% KOH | 5.73 |
| 7F | 50% Na2CO3 + 50% KOH | 6.30 |

Samples 7A–7F were saturated into a nonwoven web and tested according to Example 4. The results are given below in Table 7.3.

TABLE 7.3 Wash- and Dryclean-Durability and Wet Tensile Strengths of Treated Nonwoven Samples

| Sample | Wash-Durability (Cycles Passed) | Dryclean-Durability (Rating) | Tensile Strength (g./in.) DOWPER | Tensile Strength (g./in.) Hot Deter. |
|---|---|---|---|---|
| 7A | 9 | 1 | 159 | 584 |
| 7B | 11 | 2.5 | 322 | 818 |
| 7C | 16 | 3.25 | 419 | 897 |
| 7D | 9 | 3.7 | 443 | 987 |
| 7E | 16 | 3.75 | 520 | 906 |
| 7F | 9 | 3.6 | 412 | 519 |

Sample 7 of this invention neutralized to the required extent with fixed base as in Samples 7B–7E gives generally superior wash- and dryclean-durability results and wet tensile strengths relative to Samples 7A and 7F, not neutralized to the required extent.

EXAMPLE 8

Preparation of a Softer Waterborne Polymeric Binder Containing Fumaric Acid, Neutralization, Application to a Substrate, and Evaluation Preparation of Sample 8. To a 3-liter stirred glass reactor which contained 800 g. deionized ("DI") water, 65.6 g. sodium lauryl sulfate, and 40 g. fumaric acid and which had been swept with nitrogen for 30 minutes at ambient temperature and then heated to 60 C. was added 66 g. Monomer Emulsion #1 ("ME#1") and 15 g. of DI water. After two minutes, solutions of 5 g. 0.15% aqueous iron sulfate heptahydrate, 3.3 g. ammonium persulfate in 20 g. DI water, and 0.17 g. sodium bisulfite in 20 g. DI water were added at a temperature of 59 C. An exotherm to 63 C. was observed over the next minute and the concurrent addition of the balance of ME#1 and a solution of 0.88 g. sodium bisulfite in 60 g. DI water was begun. The addition proceeded over a period of 120 minutes with the temperature during the addition being 62–65 C. At the end of the addition 30 g. DI water was added. After a period of 5 minutes during which the temperature had fallen from 62.5 C. to 60 C., solutions of 1.0 g. t-butyl hydroperoxide in 10 g. DI water and 0.7 g. isoascorbic acid in 10 g. DI water were added. Fifteen minutes later, with the temperature at 55 C., identical t-butyl hydroperoxide and isoascorbic acid solutions were added. After an additional 10 minutes, with the temperature at 53 C., two additional identical solutions were added. Sample 8 had a solids content of 39.1% and a particle size of 60 nanometers.

TABLE 8.1 Monomer Emulsion #1 (ME#1) for Example 6

500 g. DI water
16.5 g. sodium lauryl sulfate
560 g. ethyl acrylate
400 g. butyl acrylate Portions of Sample 8 were neutralized according to the method of Example 3 using the neutralizing agents as given below in Table 8.2. Samples 8A–8E were used in treating a porous nonwoven web and tested for dry-clean-durability as described in Example 4; the results are given in Table 8.2.

TABLE 8.2. Neutralizing and Testing Nonwovens made with Sample 8

| Sample | % Copolymerized Acid Neutralized | Dryclean-Durability (Rating) |
|---|---|---|
| 8A | 0% (+10% DADMAC) | 1 |
| 8B | 10% Na2CO3 + 10% KOH (+10% DADMAC) | 1.8 |
| 8C | 20% Na2CO3 + 20% KOH (+10% DADMAC) | 2 |
| 8D | 30% Na2CO3 + 30% KOH (+10% DADMAC) | 3.5 |
| 8E | 50% Na2CO3 + 50% KOH (+20% DADMAC) | 1 |

Samples 8B, 8C, and 8D of this invention neutralized to the required degree give superior dryclean-durability when compared with Samples 8A and 8E, which are not neutralized to the required degree.

EXAMPLE 9

Preparation of a Waterborne Polymeric Binder Containing A Half Ester of Fumaric Acid (Monobutyl Fumarate), Neutralization, Application to a Substrate, and Evaluation

Preparation of Sample 9

A 3-liter stirred glass reactor which contained 900 g. deionized ("DI") water and 40 g. sodium lauryl sulfate was heated to 80 C. A solution of 2.2 g. ammonium persulfate in 20 g. DI water was added. The concurrent addition of ME#1 and a solution of 2.2 g. ammonium persulfate in 75 g. DI water was begun. The addition proceeded over a period of 105 minutes with the temperature during the addition being 78–85 C. At the end of the addition 35 g. DI water was added. After a period of 65 minutes during which the temperature had fallen from 83 C. to 53 C., solutions of 1.0 g. t-butyl hydroperoxide in 5 g. DI water and 0.5 g. isoascorbic acid in 10 g. DI water were added. Thirty minutes later, with the temperature at 47 C., identical t-butyl hydroperoxide and isoascorbic acid solutions were added. After an additional 15 minutes, with the temperature at 44 C., two additional identical solutions were added. Sample 9 had a solids content of 41.6% and a particle size of 90 nanometers.

TABLE 9.1 Monomer Emulsion #1 (ME#1) for Example 9

275 g. DI water
20 g. sodium lauryl sulfate
950 g. ethyl acrylate
50 g. monobutyl fumarate Portions of Sample 9 were neutralized according to the method of Example 3 using the neutralizing agents and achieving the pH values as given below in Table 9.2. The number of equivalents of acid available was taken to be the same as the number of equivalents of acid in an equimolar amount of fumaric acid, TABLE 9.2. Characteristics of Neutralized Treatments

| Sample | % Copolymerized Acid Neutralized | pH |
|---|---|---|
| 9A | 0 | 2.67 |
| 9B | 5% Na2CO3 + 5% KOH | 5.06 |
| 9C | 10% Na2CO3 + 10% KOH | 5.80 |
| 9D | 10% Na2CO3 + 10% KOH (+10% DADMAC) | 5.86 |
| 9E | 20% Na2CO3 + 20% KOH | 7.40 |
| 9F | 20% Na2CO3 + 20% KOH (+10% DADMAC) | 7.54 |
| 9G | 30% Na2CO3 + 30% KOH | 8.26 |
| 9H | 50% Na2CO3 + 50% KOH | 9.41 |

Samples 9A–9H were saturated into a nonwoven web and tested according to Example 4. The results are given below in Table 9.3.

TABLE 9.3 Wash- and Dryclean-Durability of Treated Nonwoven Samples

| Sample | Wash-Durability (Cycles Passed) | Dryclean-Durability (Rating) | Tensile Strength (g./in.) DOWPER | Tensile Strength (g./in.) Hot Deter. |
|---|---|---|---|---|
| 9A | 3 | 1 | 38 | 135 |
| 9B | 3 | 1 | 73 | 253 |
| 9C | 7 | 2 | 145 | 319 |
| 9D | 18 | 2.1 | 205 | 342 |
| 9E | 10 | 2.75 | 190 | 306 |
| 9F | 18 | 3.25 | 237 | 318 |
| 9G | 5 | 2 | 162 | 244 |
| 9H | 2 | 1 | 79 | 141 |

Sample 9 of this invention neutralized to the required extent with fixed base as in Samples 9C–9H give generally superior wash- and dryclean-durability results and wet tensile strengths when compared with. Samples 9A, 9B, and 9F, which are not neutralized to the required extent.

EXAMPLE 10

Effect Of particle Size on Performance of Itaconic Acid and Acrylic Acid Containing Polymeric Binders Sample 1 and Comparative Sample A were remade using 0.25% sodium lauryl sulfate in place of the 2.3% sodium lauryl sulfate used in Example 1 and Comparative Example A, in order to prepare larger particle size analogues of those samples. The larger particle size analogue of Sample 1 is designated Sample 10A. The larger particle size analogue of Comparative Sample A is designated Comparative Sample 10B.

Table 10.1. Characteristics of Particle Size Variations

| Sample | Composition | Particle Size (nanometers) |
|---|---|---|
| 1 | 95 EA/5 IA | 60 |
| 10A | 95 EA/5 IA | 297 |
| Comp. A | 94.5 EA/5.5 AA | 60 |
| Comp. 10B | 94.5 EA/5.5 AA | 257 |

Each of the samples characterized in Table 10.1 was neutralized to the extent of 20% with Na2CO3 and an additional 20% with KOH; additionally, 10% DADMAC based on equivalents of acid was added, according to the method of Example 3. A nonwoven web was treated with each neutralized sample and was tested, according to the method of Example 4. The results are given in Table 10.2.

TABLE 10.2 Wash- and Dryclean-Durability of Treated Nonwoven Samples

| Sample | Wash-Durability (Cycles Passed) | Dryclean-Durability (Rating) |
|---|---|---|
| 1 | 30 | 4.5 |
| 10A | 12 | 3.2 |
| Comp. A | 0 | 2.2 |
| Comp. 10B | 0 | 2.7 |

All of the samples were neutralized with fixed base to a degree within the required degree of neutralization. The compositions of this invention neutralized to a required degree of neutralization, Samples 1 and 10A, gave superior wash- and dryclean-durability when compared to the two comparative samples, Comp. A and Comp. 10B. The smaller particle size sample of this invention, Sample 1, performed better than the larger particle size sample of this invention, Sample 10A.

EXAMPLE 11

Preparation of Waterborne Polymeric Binder Containing Fumaric Acid, Treatment of Rayon Nonwoven, and Evaluation

Preparation of Sample 11

To a 3-liter stirred glass reactor which contained 1000 g. deionized ("DI") water, 2.5 g. sodium lauryl sulfate, and 50 g. fumaric acid (FA) and which had been swept with nitrogen for 30 minutes at ambient temperature and then heated to 55 C. was added 66 g. Monomer Emulsion #1 ("ME#1") and 15 g. of DI water. After two minutes, solutions of 5 g. 0.15% aqueous iron sulfate heptahydrate, 3.3 g. ammonium persulfate in 20 g. DI water, and 0.17 g. sodium bisulfite in 20 g. DI water were added at a temperature of 52.5 C. An exotherm to 56.5 C. was observed over the next minute and the concurrent addition of the balance of ME#1 and a solution of 0.88 g. sodium bisulfite in 60 g. DI water was begun. The addition proceeded over a period of 126 minutes with the temperature during the addition being 56.5 C.-57.5 C. At the end of the addition 30 g. DI water was added. After a period of 20 minutes during which the temperature had fallen from 57 C. to 55 C., solutions of 1.0 g. t-butyl hydroperoxide in 10 g. DI water and 0.7 g. isoascorbic acid in 10 g. DI water were added..Fifteen minutes later, with the temperature at 52.5 C., identical t-butyl hydroperoxide and isoascorbic acid solutions were added. After an additional thirty minutes, with the temperature at 42 C., two additional identical solutions were added. Sample 11 had a solids content of 39.1% and a particle size of 110 nanometers.

TABLE 11.1 Monomer Emulsion #1 (ME#1) for Example 11

300 g. DI water
30.8 g. sodium lauryl sulfate
950 g. ethyl acrylate

Sample 11 was neutralized in the manner of Example 3 to the extent of 20% with Na2CO3 and 20% with KOH. Additionally, 10%, on an equivalents basis, DADMAC was added. Treatment of the nonwoven web and testing were carried as in Example 4, with the exception that a Rayon web was used. A carded nonwoven web was prepared at a nominal weight of 1 oz./sq. yd. using Courtaids 100% viscose rayon, 1.5 denier, 19/16 inch staple length, crimped, dull luster.

Table 11.2 Evaluation of Nonwoven Properties of Rayon Nonwovens Treated with Partially Neutralized Sample 11

| | |
|---|---|
| Wash-durability (Washes Survived) | >35 |
| Dryclean Durability (Rating) | 5 |
| Tensile Strengths (g./in.) DOWPER wet | 142 |

Sample 11 of this invention neutralized with fixed base to the required degree exhibits a high level of performance when saturated into a rayon nonwoven.

EXAMPLE 12

Preparation of Itaconic Acid Binder, Partial Neutralization, Application to a Glass Fiber Nonwoven, and Evaluation

Preparation of Sample 12

To a 5-liter stirred glass reactor which contained 775 g. deionized ("DI") water and 12 g. sodium lauryl sulfate (28%) and which had been swept with nitrogen for 47 minutes while heating to 88 C. was added 89 g. Monomer Emulsion #1 ("ME#1") and 25 g. of DI water. After two minutes, a solution of 4.2 g. of sodium persulfate in 42 g. DI water was added at a temperature of 85 C. An exotherm to 87 C. was observed over the next minute and the concurrent addition of the balance of ME#1 and a solution of 2.5 g. sodium persulfate in 120 g. DI water was begun. The addition proceeded over a period of 120 minutes with the temperature during the addition being 85 C. At the end of the addition 30 g. DI water was added. After a period of 35 minutes during which the reaction mixture had been cooled to 80 C., solutions of 12 g. ferrous sulfate heptahydrate (0.1%) and 1 g. sodium persulfate in 25 g. DI water were added. Twenty minutes later solutions of 1.7 g. t-butyl hydroperoxide in 15 g. DI water and 0.85 g. isoascorbic acid in 25 g. DI water were added with the temperature at 63 C. After an additional 15 minutes, with the temperature at 58 C., two additional identical solutions were added. After an additional 15 minutes, with the temperature at 55 C., two additional identical solutions were added. Sample 12 had a solids content of 44.1%, a particle size of 105 nanometers, and pH=1.92.

TABLE 12.1 Monomer Emulsion #1 (ME#1) for Example 12

900 g. DI water
48.0 g. sodium lauryl sulfate(28%)

857 g. ethyl acrylate (EA)
67.2 g. itaconic acid (IA)
747.4 g. methyl methacrylate (MMA)
8.4 g. hydroxyethyl methacrylate (HEMA)

Sample 12 was neutralized to the extent of 20% with Na2CO3 and 20% with KOH, each neutralization being on the basis of equivalents of itaconic acid; additionally, 10%, on an equivalents basis, of DADMAC was added. A wet-laid handsheet was prepared using Owens-Corning FIBERGLAS OCF685 1-inch M-Glass at a basis weight of 2 lbs./100 square feet. The sheet was saturated to a level of 20% add-on (on a dry weight basis) and cured at 200 C. for 3 minutes.

Dry tensile strength was determined by using 1-inch by 4-inch test strips cut from the saturated sheet. Tensile strength was determined a 2-inch gage length with a jaw speed of 2 inches/minute. Wet tensile was determined in the same manner as dry tensile with the exception that the test strip was soaked for 10 minutes at 180 F. in water at pH=7 prior to testing. Hot tensile was determined in the same manner as dry tensile with the exception that a jaw speed of 1-inch/minute after a one minute dwell time in the test chamber at 350 F. prior to the test.

Table 12.2 Tensile testing of Treated Glass Fiber Nonwoven

| | |
|---|---|
| Dry Tensile Strength (Lbs.) | 28.5 |
| Wet Tensile Strength (Lbs.) | 14.2 |
| Hot Tensile Strength (Lbs.) | 2.5 |

A glass fiber nonwoven treated with a composition of this invention neutralized to a required degree with fixed base exhibited a useful set of strength properties.

What is claimed is:

1. A method for treating a nonwoven consisting essentially of:

(a) forming a waterborne formaldehyde-free composition comprising at least one polymeric binder, said binder consisting essentially of a polymer having at least one copolymerized ethylenically-unsaturated dicarboxylic acid, the half ester thereof, or the anhydride thereof, in an amount of from about 0.5% to about 10%, by weight based on the weight of said binder;

(b) contacting said composition with at least one fixed base sufficient in amount to neutralize from about 20% to about 80% of the calculated equivalents of acid of said copolymerized dicarboxylic acid, the half ester thereof, or the anhydride thereof;

(c) applying said composition to said nonwoven; and (d) heating said composition.

2. The method of claim 1 wherein said at least one copolymerized ethylenically-unsaturated dicarboxylic acid, the half ester thereof, or the anhydride thereof, is present in an amount of from about 2% to about 8%, by weight based on the weight of said binder.

3. The method of claim 1 wherein said at least one copolymerized ethylenically-unsaturated dicarboxylic acid, the half ester thereof, or the anhydride thereof, is present in an amount of from about 4% to about 6%, by weight based on the weight of said binder.

4. The method of claim 1 wherein said fixed base sufficient in amount to neutralize from about 40% to about 60% of the calculated equivalents of acid is used.

* * * * *